US008641387B2

(12) United States Patent
Wang

(10) Patent No.: US 8,641,387 B2
(45) Date of Patent: Feb. 4, 2014

(54) INFLATING PUMP WITH AUXILIARY KNOTTING FUNCTIONS

(76) Inventor: Chia-Leh Wang, Cerritos, CA (US)

( * ) Notice: Subject to any disclaimer, the term of this patent is extended or adjusted under 35 U.S.C. 154(b) by 292 days.

(21) Appl. No.: 13/218,904

(22) Filed: Aug. 26, 2011

(65) Prior Publication Data

US 2013/0052052 A1 Feb. 28, 2013

(51) Int. Cl.
*F04B 9/14* (2006.01)
*F04B 35/06* (2006.01)

(52) U.S. Cl.
CPC . *F04B 9/14* (2013.01); *F04B 35/06* (2013.01); *B65H 2601/325* (2013.01)
USPC ..... 417/234; 417/313

(58) Field of Classification Search
CPC ..... F04B 35/06; F04B 9/14; B65H 2601/325
USPC ..... 417/234, 460, 467, 468, 469, 559, 313; 141/314, 114; 289/17, 18.1, 11, 13, 14, 289/15
See application file for complete search history.

(56) References Cited

U.S. PATENT DOCUMENTS

| | | | | |
|---|---|---|---|---|
| 4,955,412 | A * | 9/1990 | Younts et al. | 141/114 |
| 8,307,612 | B1 * | 11/2012 | Sikorcin | 53/284.7 |
| 2002/0088894 | A1 * | 7/2002 | Garza | 242/566 |

* cited by examiner

*Primary Examiner* — Bryan Lettman
(74) *Attorney, Agent, or Firm* — Egbert Law Offices, PLLC

(57) ABSTRACT

An inflating pump with auxiliary knotting functions for filling up air balloons has a cylinder, piston, actuating shaft, operating handle and outlet nozzle. The piston is set slidably into the actuating space of the cylinder. The inner end of the actuating shaft is linked to the piston, and the outer end protruded from one end of the cylinder. The operating handle is linked to the outer end of the actuating shaft. The outlet nozzle is set to connect with the actuating space of the cylinder. An auxiliary knotting portion is set with a spacing to the outlet nozzle and has a bulge and an internal flange formed at end of the bulge for knotting purposes. After the air balloon is filled up with air, the user could rewind the opening of the air balloon for auxiliary knotting by taking the bulge and internal flange as the guiding structure.

3 Claims, 8 Drawing Sheets

INFLATING PUMP WITH AUXILIARY KNOTTING FUNCTIONS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an inflating pump, and more particularly to an innovative one which has auxiliary knotting functions for air balloons.

2. Description of Related Art Including Information Disclosed Under 37 CFR 1.97 and 37 CFR 1.98.

The inflating pump herein refers to a special inflating pump for air balloons, rather than for tires.

The inflating pump for air balloons is typically provided with a cylinder; of which, a tapered outlet nozzle is protruded from the top of the cylinder for sleeving of the opening of air balloons. A handle is protruded from the end of the cylinder, extended into the cylinder via a shaft lever and connected with a piston in the cylinder. With this design, the users push and pull the handle repetitively to activate the piston such that compressed air is released from the outlet nozzle to fill up the air balloons.

Alternatively, the handle and shaft lever of the conventional inflating pump for air balloons can be set at the top of the cylinder, and the outlet nozzle set at the handle.

Some shortcomings are still observed from either type of said inflating pumps for air balloons. For instance, when the inflating pump is employed to fill up an air balloon, the users may find it very difficult for knotting of the opening due to lack of any design of auxiliary knotting mechanism on the air balloons.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

Based on the unique structure of the present invention wherein the "inflating pump with auxiliary knotting function" allows said auxiliary knotting portion to be arranged with a spacing to the outlet nozzle, when the present invention is sleeved onto the air balloon to fill up it, the user could rewind the opening of air balloon for auxiliary knotting by taking the bulge and internal flange of auxiliary knotting portion as the guiding structure. So, this could increase substantially the value and functionality of the inflating pump with better applicability.

The improvements brought about by this invention are as follow:

Based on the structural wherein a threading portion is additionally set on the bulge of the auxiliary knotting portion as well as the outlet nozzle, this allows for threading and limitation of existing thread. Moreover, the end of said thread is extended to an adjacent location at one side of the internal flange for knotting purposes. When the opening of the air balloon is rewound for knotting, the end of the thread can be connected together such that the thread is taken as the pull wire of air balloon. Thus, the pull wire of air balloon is connected while the knotting of the opening of air balloon is finished.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

FIGS. 1-4 depict preferred embodiments of an inflating pump of the present invention with auxiliary knotting functions, which, however, are provided for only explanatory objective for patent claims. Said inflating pump is exclusively used for filling up air balloons and has auxiliary knotting functions.

Figure 1:
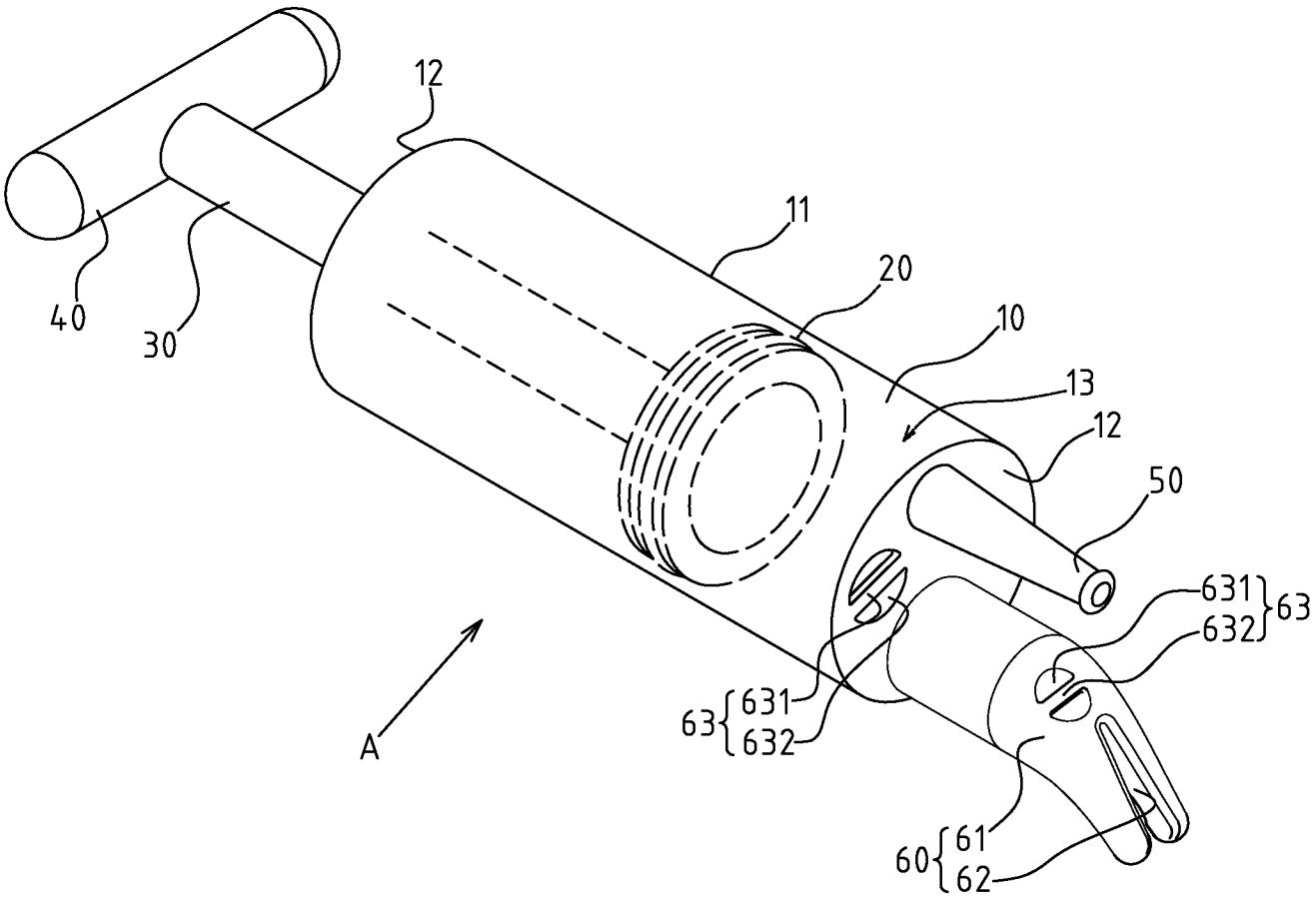
FIG. 1 is a schematic view of the preferred embodiment of the present invention.

The inflating pump A includes a cylinder 10 shown in FIG. 1, containing a cylinder wall 11, two ends 12 and an actuating space 13. A piston 20 is set slidably into the actuating space 13 of the cylinder 10. An actuating shaft 30 has an inner end linked to the piston 20, and an outer end protruded from one end of the cylinder 10. An operating handle 40 is linked to the outer end of the actuating shaft 30. An outlet nozzle 50 is set to connect with the actuating space 13 of the cylinder 10. The outlet nozzle 50 is of tapered tubular shape, allowing for sleeving of the opening 02 of the air balloon 01. At least one auxiliary knotting portion 60 is protruded with a spacing to the outlet nozzle 50. Said auxiliary knotting portion 60 contains a bulge 61 and an internal flange 62 formed at end of the bulge 61 for knotting purposes.

Figure 2:
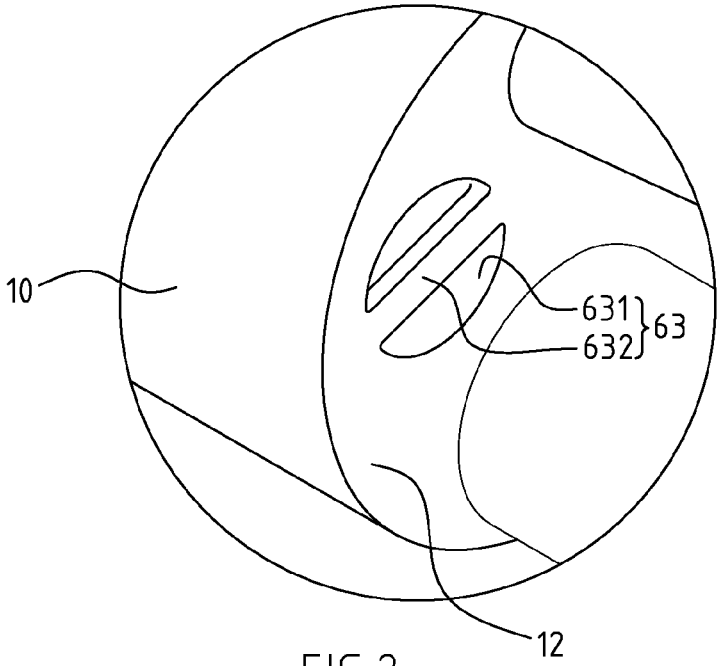
FIG. 2 is an enlarged perspective view of the threading portion of the present invention.

Referring to FIGS. 1 and 2, a threading portion 63 is set on the bulge 61 of the auxiliary knotting portion 60 as well as the outlet nozzle 50, allowing for threading and limitation of existing thread 03. Moreover, the end of said thread 03 is extended to an adjacent location at one side of the internal flange 62 for knotting purposes. When the opening 02 of the air balloon 01 is rewound for knotting, the end of the thread 03 can be connected together such that the thread 03 is taken as the pull wire of air balloon.

Figure 3:
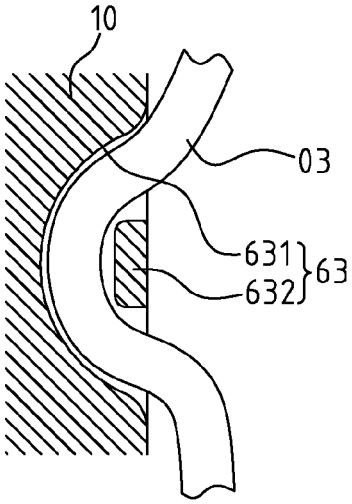
FIG. 3 is a plan sectional view of the present invention wherein the threading portion is in threading state.
Figure 4:
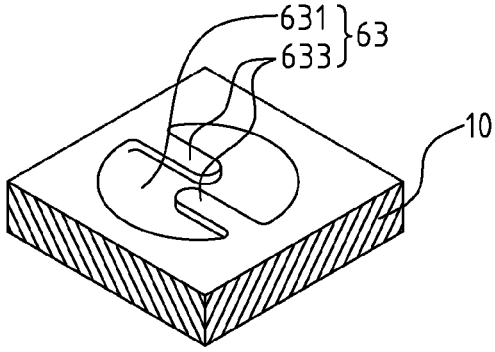
FIG. 4 is a schematic view of the present invention wherein a plurality of limited blocks are set on the threading portion.

Referring to FIGS. 3 and 4, said threading portion 63 contains a recessed slot 631 and at least one limited block 632, 633 transversely arranged on the middle section of the recessed slot 631.

Referring to FIG. 1, the outlet nozzle 50 is set at the outer end of the cylinder 10 and connected with the actuating space 13 of the cylinder 10.

Figure 7:
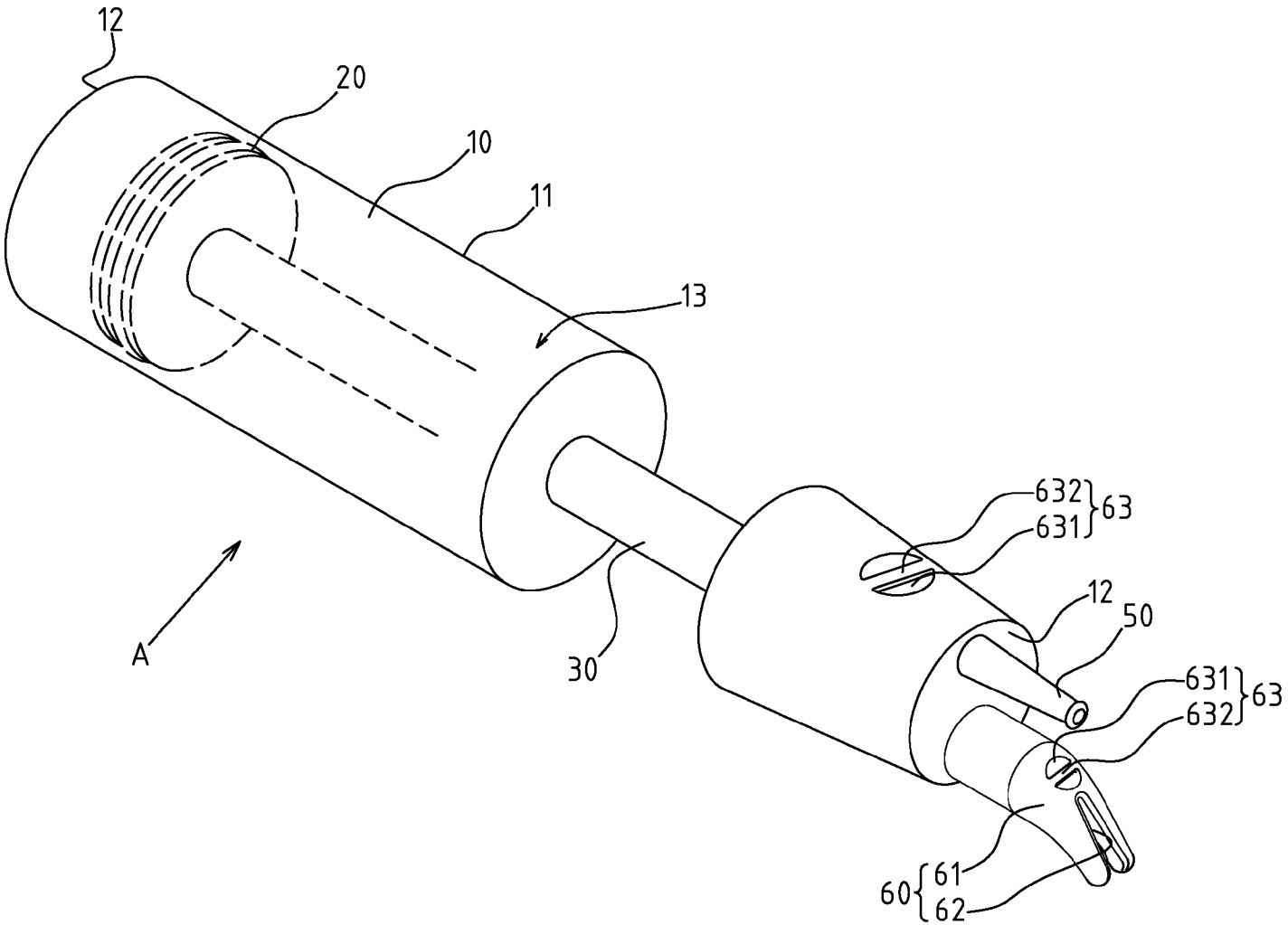
FIG. 7 is a schematic view of the present invention wherein the outlet nozzle is set on the operating handle.
Figure 8:
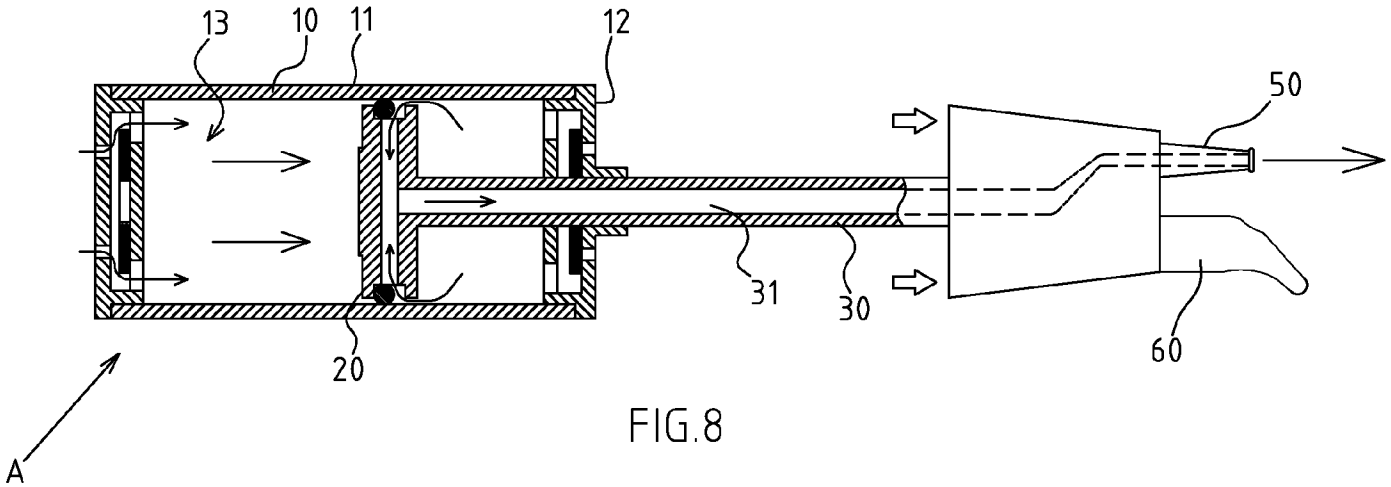
FIG. 8 is a plan sectional view 1 of a structure showing the actuating and air flow state disclosed in FIG. 7.
Figure 9:
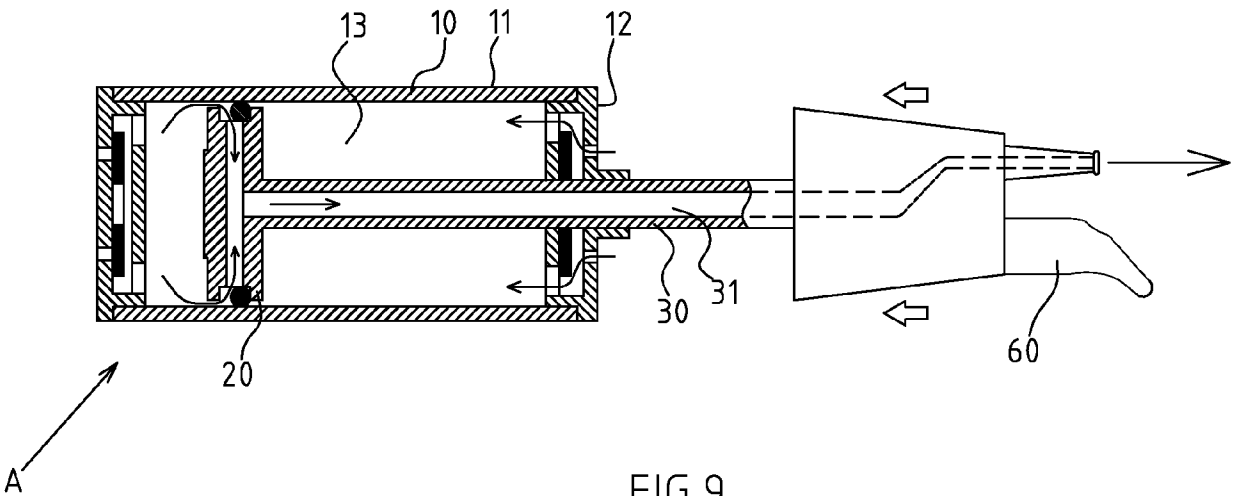
FIG. 9 is a plan sectional view 2 of a structure showing the actuating and air flow state disclosed in FIG. 7.

Referring to FIGS. 7, 8 and 9, the outlet nozzle 50 is set on the operating handle 40. The actuating shaft 30 is provided with an air flow channel 31 linked to the operating handle 40 and piston 20, such that the outlet nozzle 50 can be connected with the actuating space 13 of the cylinder 10 via the air flow channel 31.

Figure 10:
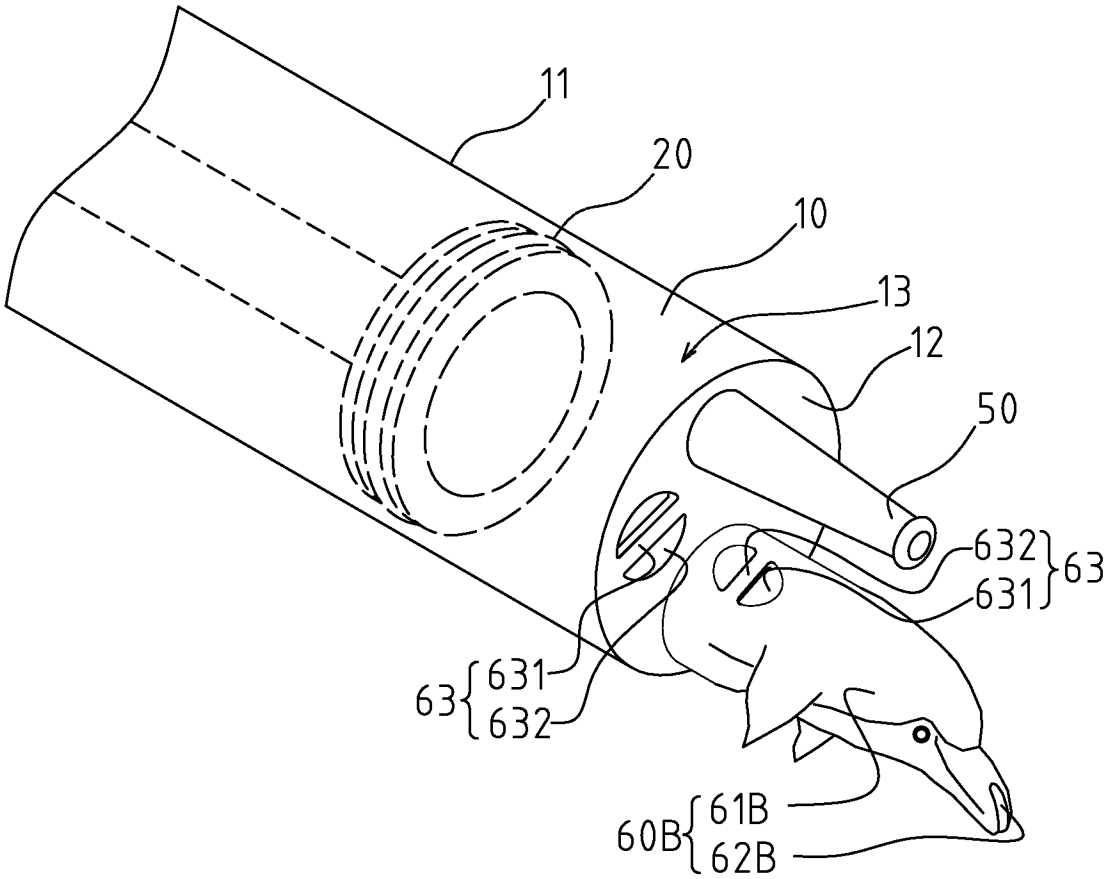
FIG. 10 is a schematic view of the preferred embodiment wherein the auxiliary knotting portion is simulated.

Referring to FIG. 10, the end of the bulge 61B of the auxiliary knotting portion 60B is of a Y-shaped pattern, at the joint of which an internal flange 62B for knotting is formed. The bulge 61B can also be simulated as simple cross sections or geometrical shapes like the head of dolphins, horses, birds or elephants.

Figure 11:
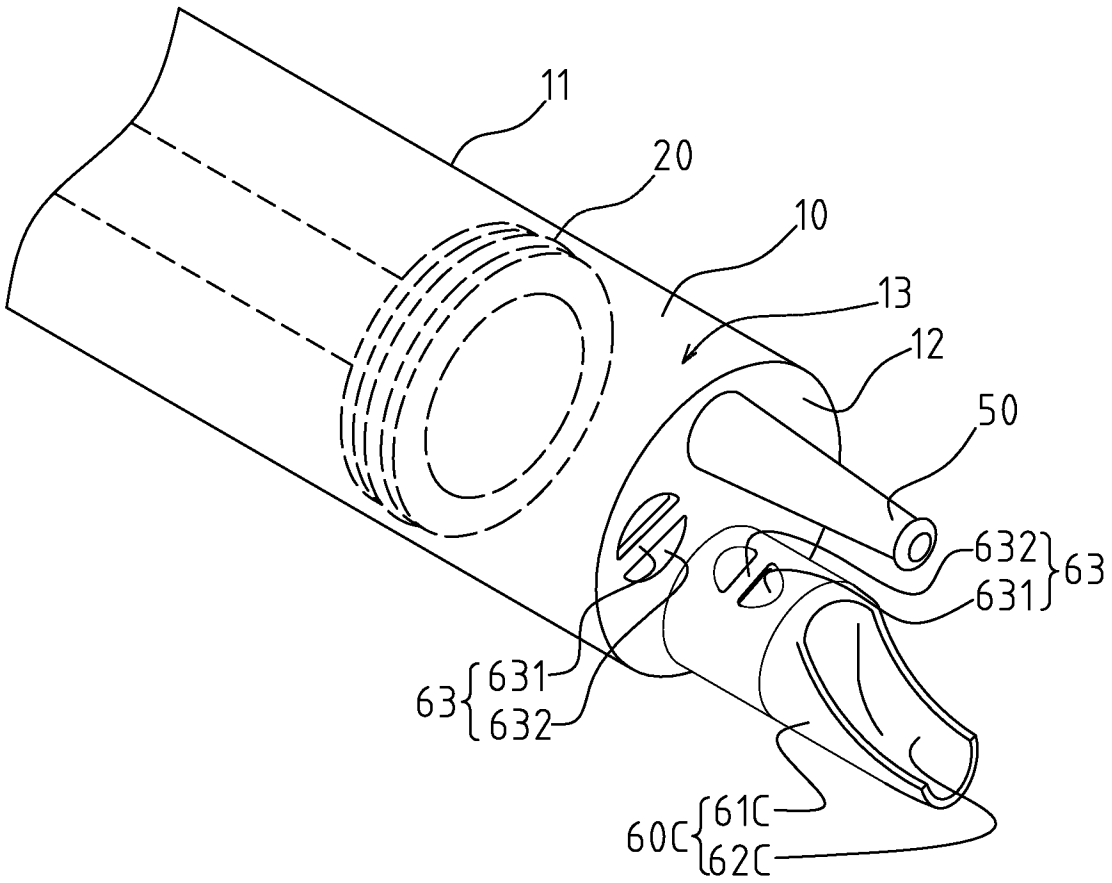
FIG. 11 is a schematic view of the preferred embodiment wherein the auxiliary knotting portion is recessed.

Referring to FIG. 11, the end or cross section of the bulge 61C of the auxiliary knotting portion 60C can have a recessed surface, onto which an internal flange 62C for knotting is formed.

Figure 5:
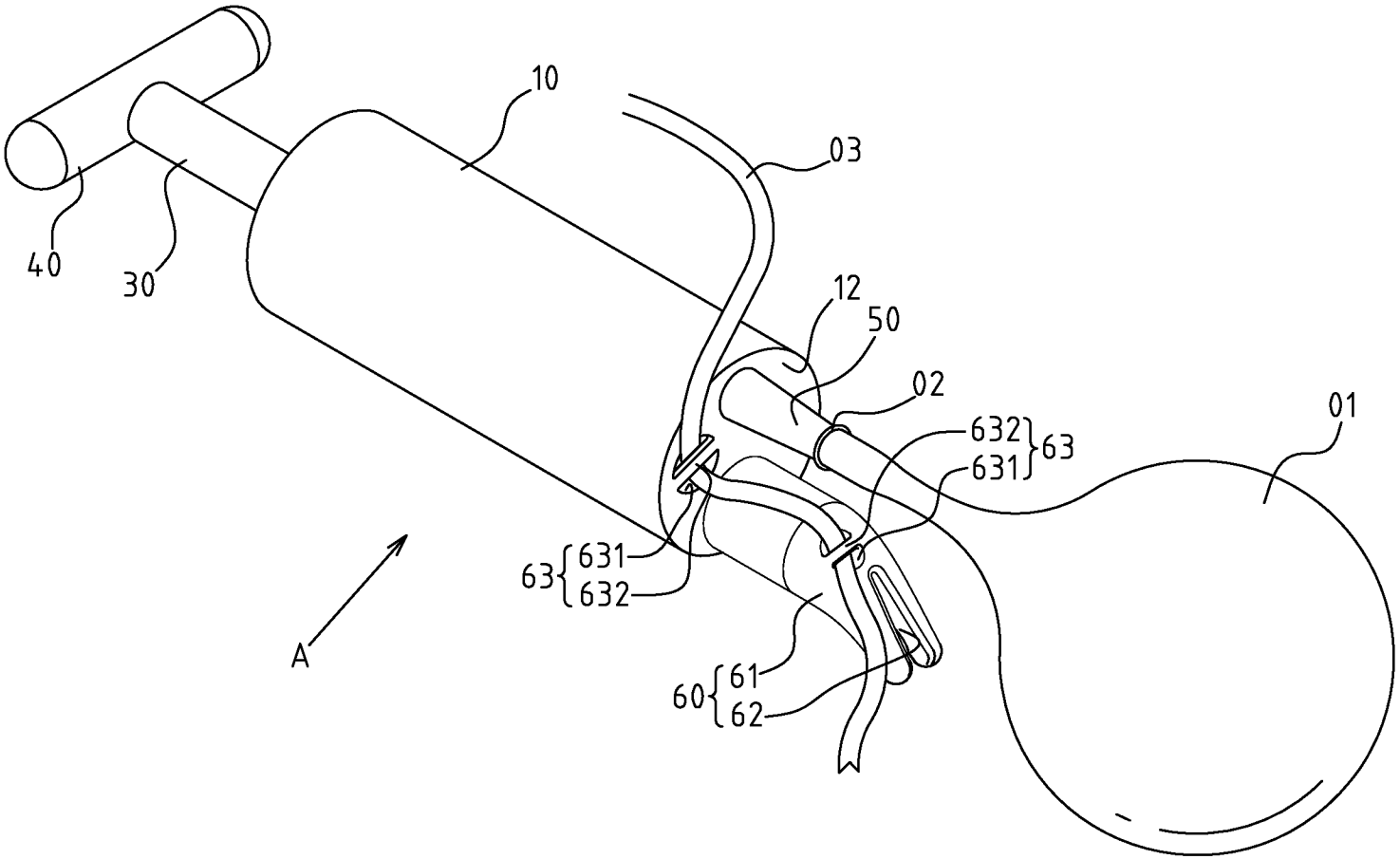
FIG. 5 is a perspective view of the present invention wherein the inflating pump is applied to fill up the air balloon.
Figure 6:
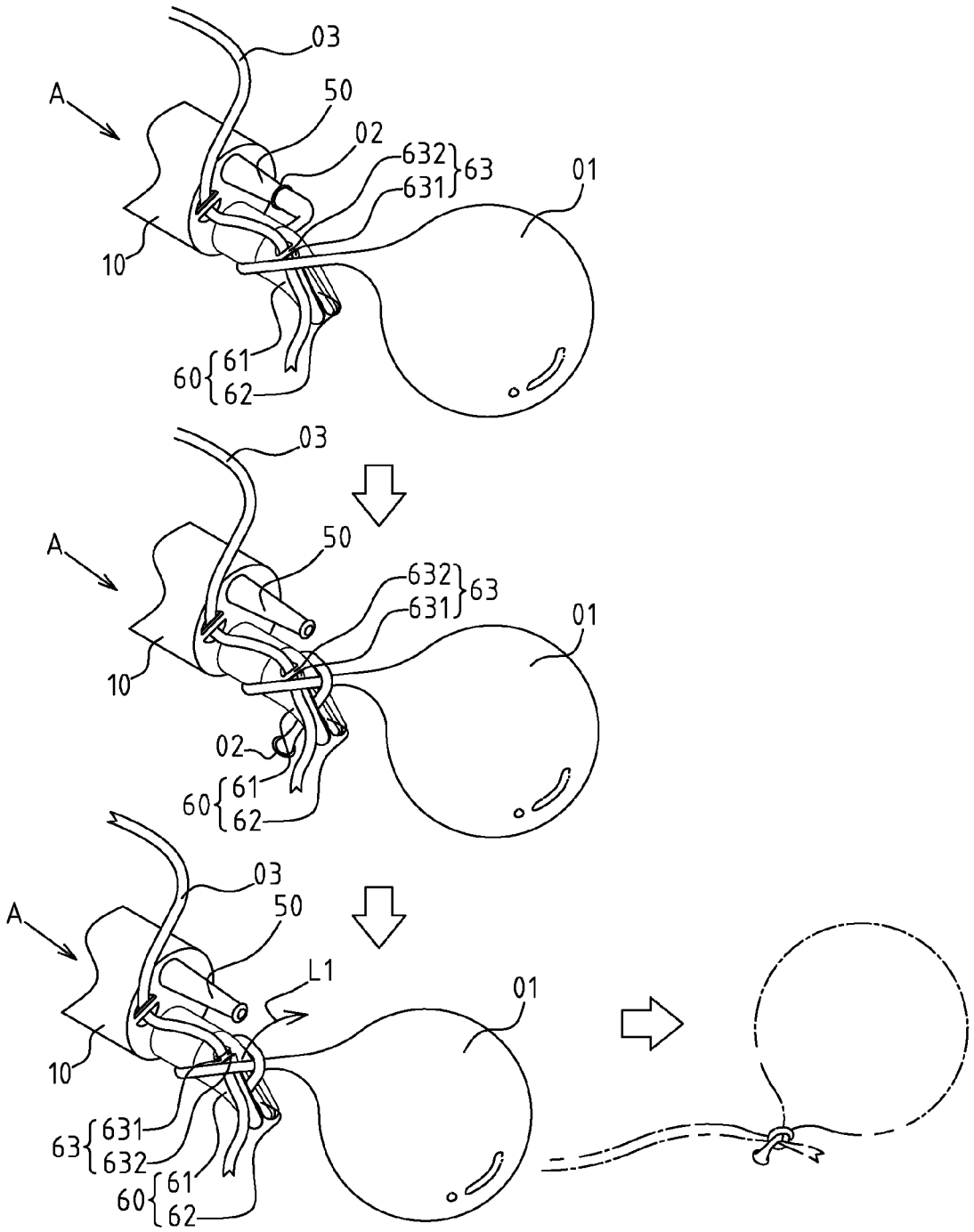
FIG. 6 is a flow process chart of the present invention wherein the auxiliary knotting portion is used for auxiliary knotting of an air balloon.

Based upon above-specified structure, the present invention is operated as follows:

Referring to FIG. 5, when the air balloon 01 is charged with air as disclosed in FIG. 1, the opening 02 of the air balloon 01 is sleeved onto the outlet nozzle 50. On the other hand, the thread 03 as a pull wire of air balloon passes through the threading portion 63, then the end of the thread 03 is extended to an adjacent location at one side of the internal flange 62 for knotting readiness. Next, the user could fill up the air balloon 01 by pushing and pulling the operating handle 40. Afterwards, as shown in FIG. 6, the user could rewind the opening 02 of air balloon 01 by taking the bulge 61 and internal flange 62 of auxiliary knotting portion 60 as the guiding structure. When the opening 02 of air balloon 01 rewinds the bulge 61 by one circle and then passes through the internal flange 62 (indicated by arrow L1) for final knotting, the end of the thread 03 can be linked together to finish the linking of the pull wire of air balloon 01.

After air balloon 01 sleeved onto the outlet nozzle 50 is filled up with air, the user could rewind the opening 02 of air balloon 01 for auxiliary knotting by taking the bulge 61 and internal flange 62 of auxiliary knotting portion 60 as the guiding structure.

I claim:

1. An inflating pump apparatus for filling an air balloon, the inflating pump apparatus comprising:

a cylinder having a cylindrical wall and a pair of ends, said cylinder having an actuating space defining by said cylindrical wall and said pair of ends;

a piston slidably positioned in said actuating space of said cylinder;

an actuating shaft having an inner end linked to said piston and an outer end extending outwardly of one of said pair of ends of said cylinder;

an operating handle linked to said outer end of said actuating shaft;

an outlet nozzle communicating with said actuating space of said cylinder, said outlet nozzle having a tapered tubular shape, said outlet nozzle having an exterior surface suitable for allowing the air balloon to be sleeved thereover; and at least one auxiliary knotting portion protruding outwardly of the other of said pair of ends of said cylinder, the auxiliary knotting portion being in spaced relation to said outlet nozzle on the other of said pair of ends of said cylinder, the auxiliary knotting portion having a bulge and an internal flange formed at an end of said bulge, said bulge having a first threading portion formed thereon, said other of said pair of ends of said cylinder having a second threading portion formed thereon, each of said first and second threaded portions having a recessed slot and a block positioned across a middle of said recessed slot such that a thread can extend into said recessed slot below said block, the air balloon being rewound for auxiliary knotting by using said bulge and said internal flange of the auxiliary knotting portion as a guiding structure after the air balloon is sleeved onto said outlet nozzle and the air balloon is filled with air.

2. The inflating pump apparatus of claim 1, said outlet nozzle positioned on said operating handle, said actuating shaft having an air flow channel linked to said operating handle and to said piston, said outlet nozzle communicating with said actuating space by way of said air flow channel.

3. The inflating pump apparatus of claim 1, the auxiliary knotting portion having a Y-shape at the end of said bulge, said internal flange formed at a joint of said Y-shape.

* * * * *